US010941513B2

(12) United States Patent
MacDonald, III et al.

(10) Patent No.: US 10,941,513 B2
(45) Date of Patent: Mar. 9, 2021

(54) HINGED HOUSING FOR A LINT TRAP OF A DRYER APPLIANCE

(71) Applicant: Haier US Appliance Solutions, Inc., Wilmington, DE (US)

(72) Inventors: Robert V. MacDonald, III, Simpsonville, KY (US); Ionelia Silvia Prajescu, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 2 days.

(21) Appl. No.: 16/391,654

(22) Filed: Apr. 23, 2019

(65) Prior Publication Data

US 2020/0340170 A1 Oct. 29, 2020

(51) Int. Cl.
*D06F 58/22* (2006.01)
*F26B 25/00* (2006.01)

(52) U.S. Cl.
CPC ..... *D06F 58/22* (2013.01); *F26B 25/007* (2013.01)

(58) Field of Classification Search
CPC ..... D06F 58/22; D06F 58/00; D06F 58/20; F26B 25/00; F26B 25/007
USPC ..... 34/82, 595–610
See application file for complete search history.

(56) References Cited

U.S. PATENT DOCUMENTS 2,776,826 A * 1/1957 Bennett ..... D06F 58/02 432/46
3,378,934 A 4/1968 Erickson
4,395,831 A * 8/1983 Nielsen ..... D06F 58/20 34/235
4,434,564 A * 3/1984 Braggins, Jr. ..... D06F 58/20 34/235
4,720,925 A * 1/1988 Czech ..... D06F 58/22 34/595
5,651,188 A * 7/1997 Swanson ..... D06F 58/22 34/595
5,675,908 A * 10/1997 Barnes ..... D06F 58/22 34/233
5,940,986 A * 8/1999 Jelinek ..... D06F 58/04 34/528
6,016,610 A * 1/2000 Sears ..... D06F 58/22 34/604
6,101,741 A * 8/2000 Sears ..... F26B 25/007 34/237
D445,974 S * 7/2001 Stratford ..... D32/30
6,843,909 B1 * 1/2005 Woltmann ..... A01K 63/045 119/260

(Continued)

FOREIGN PATENT DOCUMENTS

DE 10135471 A1 * 1/2003 ..... D06F 58/22
EP 1277872 A3 * 9/2003 ..... D06F 58/22
KR 1094548 B1 12/2011

*Primary Examiner* — Stephen M Gravini
(74) *Attorney, Agent, or Firm* — Dority & Manning, P.A.

(57) ABSTRACT

A filter system for a dryer appliance includes a front housing, a rear housing, the rear housing including two guards that define an opening, a pivotable perforated grille connected to the rear housing and pivotable between a closed position and an open position, at least a portion of the perforated grille covering the opening when it is in the closed position, and a filter removably mounted between the front housing and the rear housing, the filter being removable when the perforated grille is in the open position.

18 Claims, 11 Drawing Sheets

(56) References Cited

U.S. PATENT DOCUMENTS

| | | | | |
|---|---|---|---|---|
| 6,971,186 | B1 * | 12/2005 | Chin | D06F 58/22 34/140 |
| 6,997,966 | B2 * | 2/2006 | Iantorno | B01D 46/10 34/604 |
| 7,213,349 | B1 * | 5/2007 | Brunner | D06F 58/20 34/86 |
| 7,325,332 | B2 * | 2/2008 | Chung | D06F 58/22 34/602 |
| 7,644,515 | B2 * | 1/2010 | Doh | D06F 58/22 34/603 |
| 7,886,458 | B2 * | 2/2011 | Blair | D06F 58/22 34/83 |
| 8,015,727 | B2 * | 9/2011 | Lee | D06F 58/04 34/601 |
| 8,028,439 | B2 * | 10/2011 | Prajescu | D06F 58/06 34/601 |
| 8,631,586 | B2 * | 1/2014 | Leroy | D06F 58/30 34/595 |
| 9,593,441 | B2 | 3/2017 | Gregory et al. | |
| 9,885,143 | B2 * | 2/2018 | Grunert | D06F 58/22 |
| 9,951,464 | B2 * | 4/2018 | Lee | D06F 58/206 |
| 10,526,745 | B2 * | 1/2020 | Dunn | D06F 58/02 |
| 2003/0014880 | A1 * | 1/2003 | Baurmann | D06F 58/22 34/595 |

* cited by examiner

HINGED HOUSING FOR A LINT TRAP OF A DRYER APPLIANCE

FIELD OF THE INVENTION

The present subject matter relates generally to dryer appliances, and more particularly to dryer appliances which include improved filter systems.

BACKGROUND OF THE INVENTION

Dryer appliances generally include a cabinet with a drum mounted therein. In many dryer appliances, a motor rotates the drum during operation of the dryer appliance, e.g., to tumble articles located within a chamber defined by the drum. Alternatively, dryer appliances with fixed drums have been utilized. Typical dryer appliances also generally include a heater assembly that passes heated air through the chamber of the drum in order to dry moisture-laden articles disposed within the chamber. This internal air passes from the chamber through a vent duct to an exhaust conduit, through which the air is exhausted from the dryer appliance. Typically, a blower is utilized to flow the internal air from the vent duct to the exhaust duct. When operating, the blower may pull air through itself from the vent duct, and this air may then flow from the blower to the exhaust conduit.

A filter employing a mesh screen is typically positioned within the vent duct to collect particulate, such as lint, during operation of the dryer appliance. Such filters prevent this particulate from becoming clogged in downstream portions of the vent duct or exhaust conduit or being exhausted into the ambient environment.

However, concerns exist with known vent ducts. For example, in many cases, some particulate becomes lodged in the vent duct and does not adhere to the filter. This particulate remains in the vent duct even after removal and cleaning of the filter. Such particulate can eventually clog the vent duct or lead to other undesirable conditions. Further, access to the vent duct to remove such particulate is restricted, thus making cleaning of such particulate difficult.

Accordingly, improved dryer appliances and associated filter systems are desired. In particular, filter systems which provide improved access for particulate cleaning and which enable use of a larger, removable filter for simplifying collection of particulate within the vent duct would be advantageous.

BRIEF DESCRIPTION OF THE INVENTION

Aspects and advantages of the invention will be set forth in part in the following description, or may be obvious from the description, or may be learned through practice of the invention.

In accordance with one embodiment of the present disclosure, a dryer appliance is provided. The dryer appliance may include a cabinet, a rotatable drum positioned within the cabinet for receipt of articles for drying, and a filter system in fluid communication with the rotatable drum. The filter system may further comprise a front housing connected to the cabinet, a rear housing connected to the front housing, a perforated grille pivotably attached to the rear housing, and a filter removably mounted between the front housing and the rear housing. The rear housing may further comprise a first end, a second end, a first guard on top of the first end, a second guard on top of the second end, and an opening between the first guard and the second guard. The perforated grille may further pivot between an open position and a closed position, at least a portion of the perforated grille covering the opening the closed position.

In accordance with another embodiment of the present disclosure, a filter system is provided. The filter system may comprise a front housing, a rear housing connected to the front housing, a perforated grille pivotably attached to the rear housing, and a filter removably mounted between the front housing and the rear housing. The rear housing may further comprise a first end, a second end, a first guard on top of the first end, a second guard on top of the second end, and an opening between the first guard and the second guard. The perforated grille may further pivot between an open position and a closed position, at least a portion of the perforated grille covering the opening the closed position.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
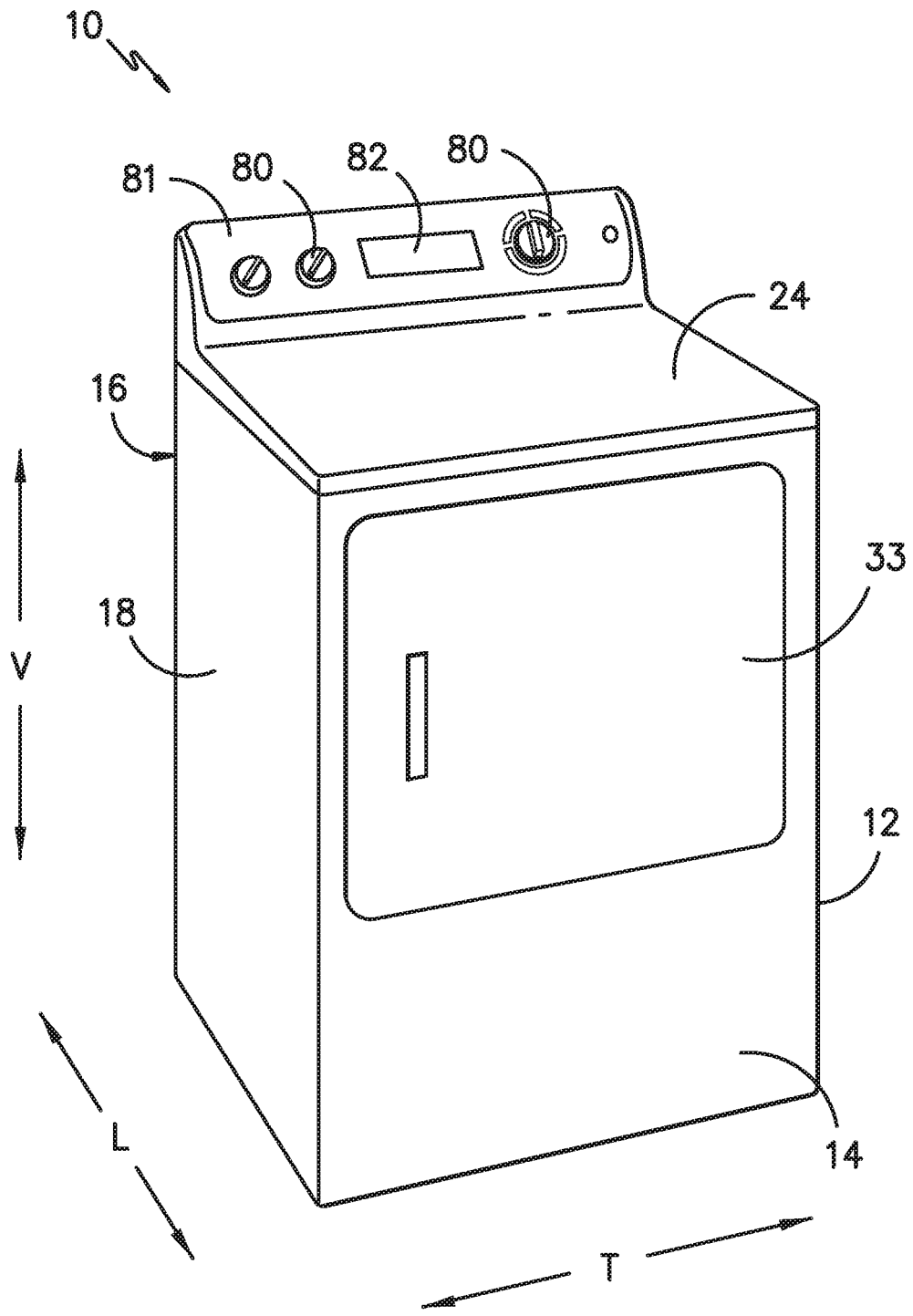
FIG. 1 provides a perspective view of one embodiment of a dryer appliance in accordance the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents In order to aid understanding of this disclosure, several terms are defined below. The defined terms are understood to have meanings commonly recognized by persons of ordinary skill in the arts relevant to the present invention. The terms "includes" and "including" are intended to be inclusive in a manner similar to the term "comprising." Similarly, the term "or" is generally intended to be inclusive (i.e., "A or B" is intended to mean "A or B or both"). The terms "first," "second," and "third" may be used interchangeably to distinguish one component from another and are not intended to signify location or importance of the individual components.

Figure 2:
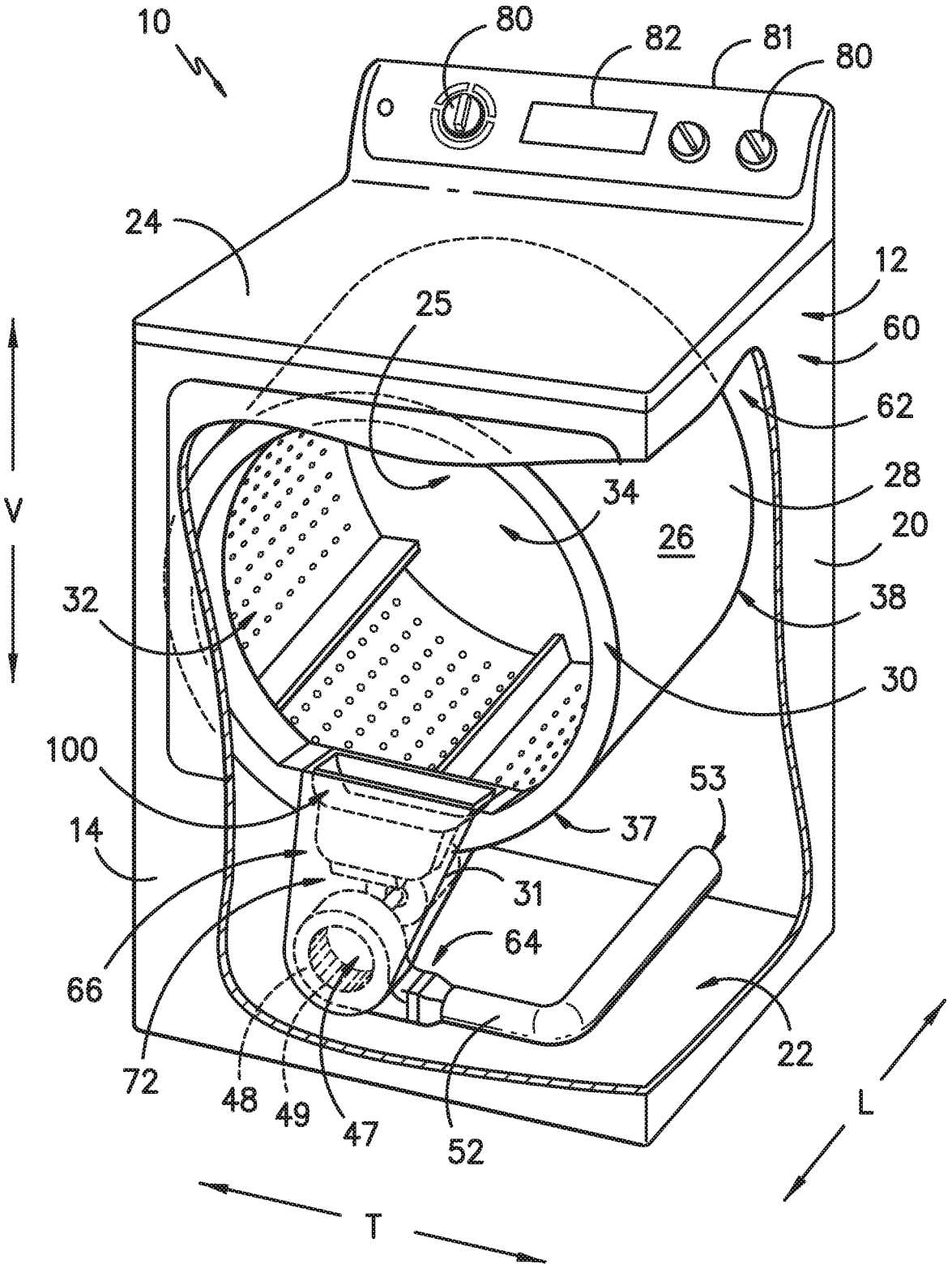
FIG. 2 provides a cut-away perspective view of an embodiment of a dryer appliance in accordance with the present disclosure.

FIG. 1 illustrates a dryer appliance 10 according to an exemplary embodiment of the present subject matter. FIG. 2 provides another perspective view of dryer appliance 10 with a portion of a cabinet or housing 12 of dryer appliance 10 removed in order to show certain components of dryer appliance 10. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. Dryer appliance 10 defines a vertical direction V, a lateral direction L, and a transverse direction T. The vertical direction V, lateral direction L, and transverse direction T are mutually perpendicular and form and orthogonal direction system.

Cabinet 12 includes a front panel 14, a rear panel 16, a pair of side panels 18 and 20 spaced apart from each other by front and rear panels 14 and 16, a bottom panel 22, and a top cover 24. These panels and cover collectively define an external surface 60 of the cabinet 12 and an interior 62 of the cabinet. Within interior 62 of cabinet 12 is a drum or container 26. Drum 26 defines a chamber 25 for receipt of articles, e.g., clothing, linen, etc., for drying. Drum 26 extends between a front portion 37 and a back portion 38, e.g., along the lateral direction L. In exemplary embodiments the drum 26 is rotational. Alternatively, however, the drum 26 may be fixedly mounted within the interior 62.

Drum 26 is generally cylindrical in shape, having an outer cylindrical wall or cylinder 28 and a front wall 30 that may define an entry 32 of drum 26, e.g., at front portion 37 of drum 26, for loading and unloading of articles into and out of chamber 25 of drum 26. Drum 26 also includes a back or rear wall 34, e.g., at back portion 38 of drum 26. As is generally understood, the front wall 30 and rear wall 34 remain generally stationary during operation of the dryer appliance 10. The cylinder 28 is rotatable relative to the drum 26 (including the front wall 30 and rear wall 34), such as about a central longitudinal axis of the cylinder 28, which, in exemplary embodiments as shown, extends parallel to the lateral direction L. In alternative embodiments, entry 32 may be defined in top cover 24, and front wall 30 may be a generally solid wall.

A motor 31 may be in mechanical communication with a blower or air handler 48 such that motor 31 rotates a fan 49, e.g., a centrifugal fan, of air handler 48. Air handler 48 is configured for drawing air through chamber 25 of drum 26, e.g., in order to dry articles located therein as discussed in greater detail below. In alternative exemplary embodiments, dryer appliance 10 may include an additional motor (not shown) for rotating fan 49 of air handler 48 independently of drum 26.

Drum 26 may be configured to receive heated air that has been heated by a heater, e.g., in order to dry damp articles disposed within chamber 25 of drum 26. As discussed above, during operation of dryer appliance 10, motor 31 rotates fan 49 of air handler 48 such that air handler 48 draws air through chamber 25 of drum 26. Ambient air that is heated by the heater may thus be drawn into chamber 25 of drum 26. Within chamber 25, the heated air can remove moisture, e.g., from damp articles disposed within chamber 25. This internal air in turn flows from the chamber 25 through an outlet assembly 64 positioned within the interior 62. The outlet assembly 64 includes a vent duct 66 and an exhaust conduit 52. The exhaust conduit 52 is in fluid communication with the vent duct 66. During a dry cycle, internal air flows from the chamber 25 through the vent duct 66 to the exhaust conduit 52, and is exhausted from the exhaust conduit 52. As shown, the internal air can, for example, flow from the vent duct 66 through an exit conduit 47 defined in the vent duct 66 and air handler 48 to the exhaust conduit 52.

In exemplary embodiments, vent duct 66 can include a filter system 100 and an exhaust portion 72. As with vent duct 66, filter system 100 is in fluid communication with chamber 25 of drum 26. The exhaust portion 72 may be positioned downstream of the filter system 100 in the direction of flow of the internal air. A filter 118 of filter system 100, which may be removable, traps lint and other particulates as the internal air flows therethrough. The internal air may then flow through the exhaust portion 72 and to the exhaust conduit 52, such as through the exit conduit 47.

After the clothing articles have been dried, they are removed from the drum 26 via entry 32. A door 33 provides for closing or accessing drum 26 through entry 32.

A cycle selector knob 80 is mounted on a cabinet backsplash 81 and is in communication with a processing device or controller 82. Signals generated in controller 82 operate the motor 31 and heaters (discussed herein) in response to the position of selector knobs 80. Alternatively, a touch screen type interface may be provided. As used herein, "processing device" or "controller" may refer to one or more microprocessors or semiconductor devices and is not restricted necessarily to a single element. The processing device can be programmed to operate dryer appliance 10. The processing device may include, or be associated with, one or more memory elements such as e.g., electrically erasable, programmable read only memory (EEPROM).

It should be understood that, while FIGS. 1 and 2 illustrate embodiments wherein dryer assembly 10 is a horizontal axis dryer assembly, in other embodiments dryer assembly 10 may be, for example, a vertical axis dryer assembly or another suitable dryer assembly. In a vertical axis dryer assembly 10, for example, cylinder 28 of drum 26 may extend along the vertical axis V and is generally located between rear wall 34 and front wall 30. Accordingly, the present disclosure is not limited to horizontal axis dryer assemblies. Rather, any suitable dryer assembly is within the scope and spirit of the present disclosure.

Figure 3:
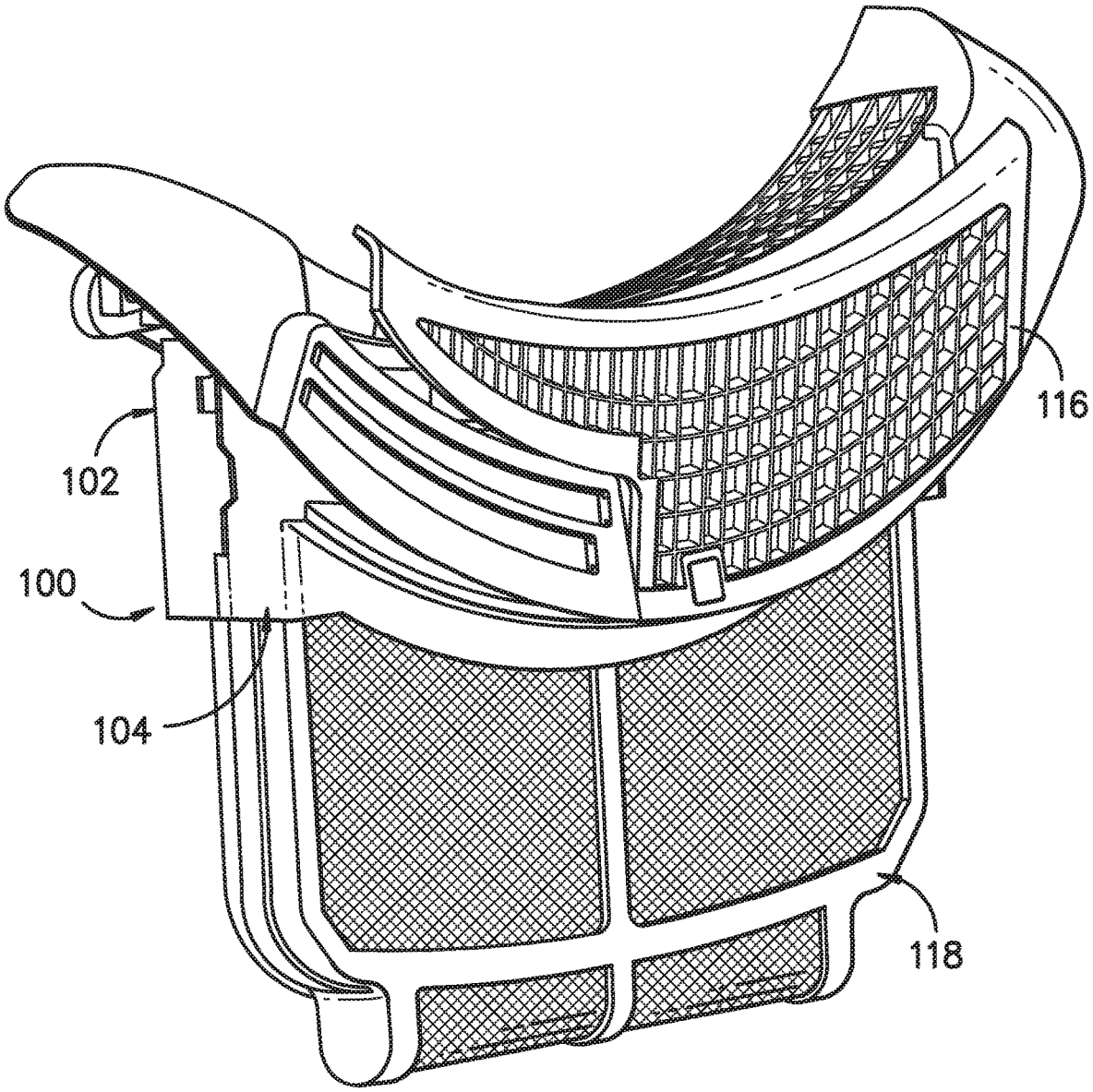
FIG. 3 provides a rear perspective view of an embodiment of a filter system with a perforated grille in the open position in accordance with the present disclosure.
Figure 4:
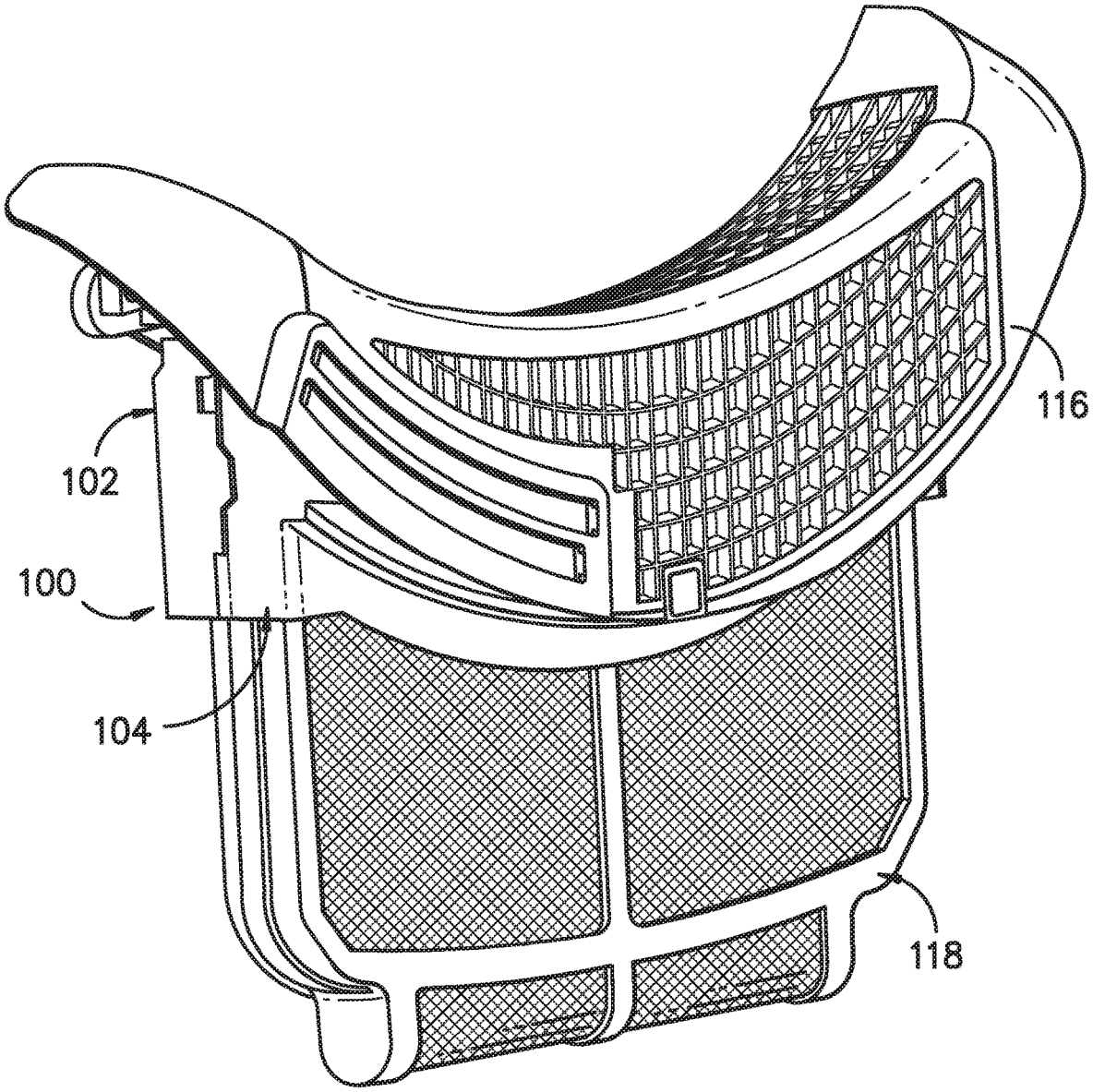
FIG. 4 provides a rear perspective view of an embodiment of a filter system with a perforated grille in the closed position in accordance with the present disclosure.
Figure 5:
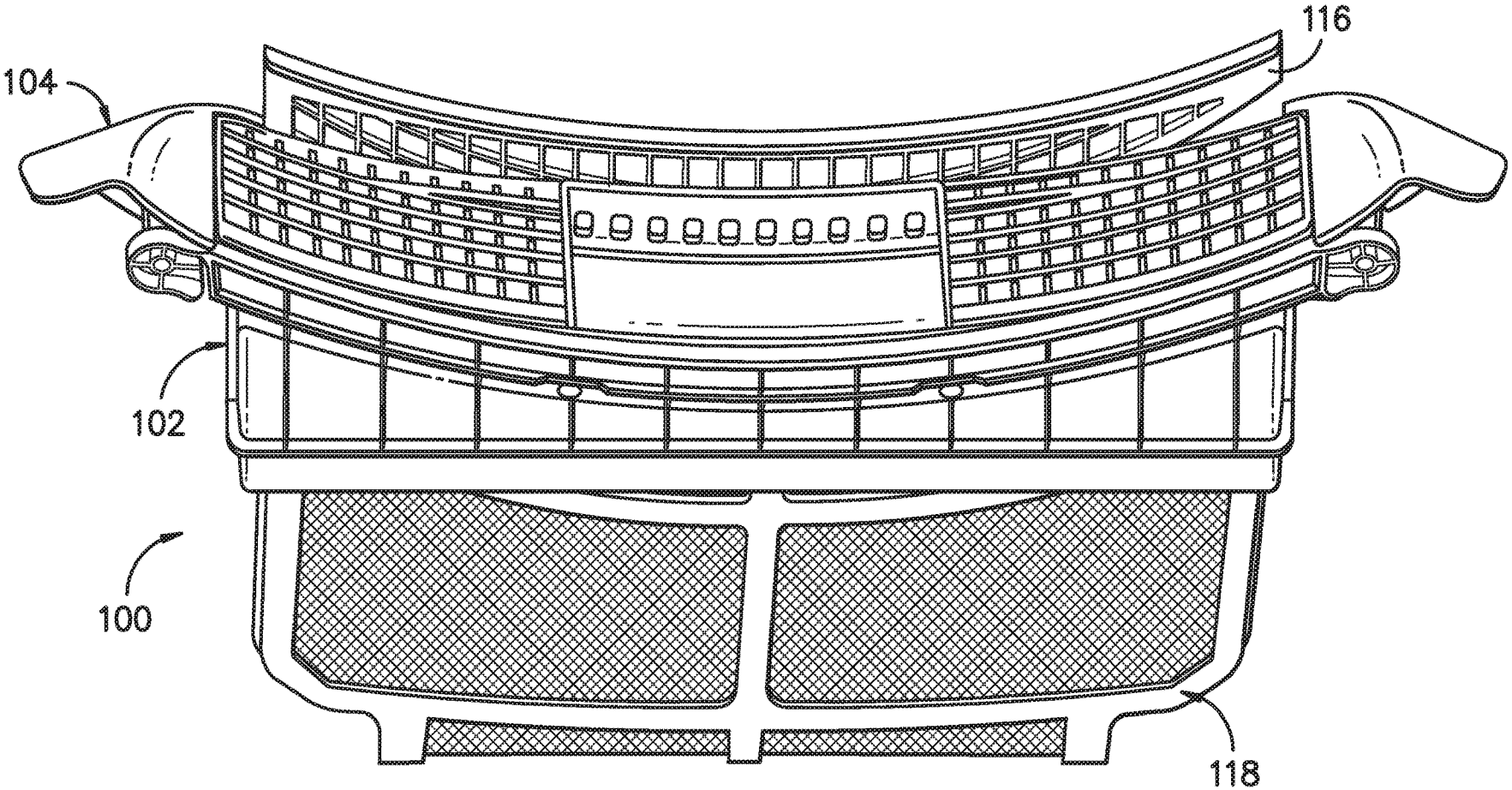
FIG. 5 provides a front perspective view of an embodiment of a filter system with a perforated grille in the open position in accordance with the present disclosure.

Embodiments of improved filter system 100 will now be addressed in greater detail. FIGS. 3 through 5 provide various perspectives of certain embodiments of filter system 100. As illustrated, filter system 100 may include a front housing 102, a rear housing 104, a perforated grille 116, and a removable filter 118. Filter systems 100 in accordance with the present disclosure advantageously provide the ability to open filter assembly 100 via perforated grille 116, thereby expanding the area available to remove and replace filter 118. Filter system 100 may enable the use of filters 118 with a larger cross-section, thus permitting filter 118 to occupy a volume of space within filter system 100 or vent duct 66 where lint or other particulates would be likely to collect, simplifying the collection of such particulates. Additionally or alternatively, the ability to open embodiments of filter system 100 may provide the advantage of greater access within filter system 100 and vent duct 66 for cleaning tools, such as vacuum cleaner attachments, to operate effectively.

Figure 6:
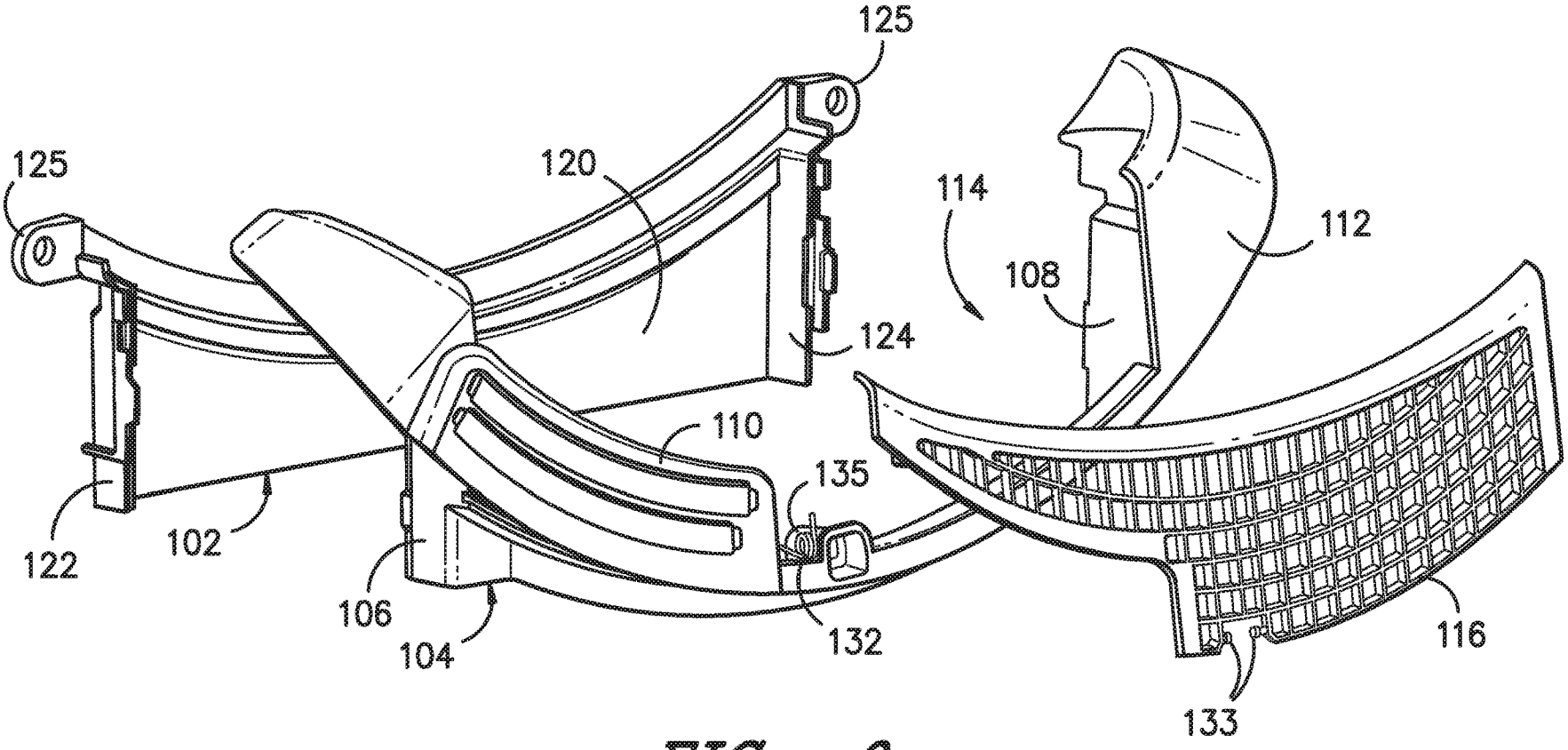
FIG. 6 provides a rear perspective exploded view of an embodiment of a filter system without a filter in accordance with the present disclosure.
Figure 7:
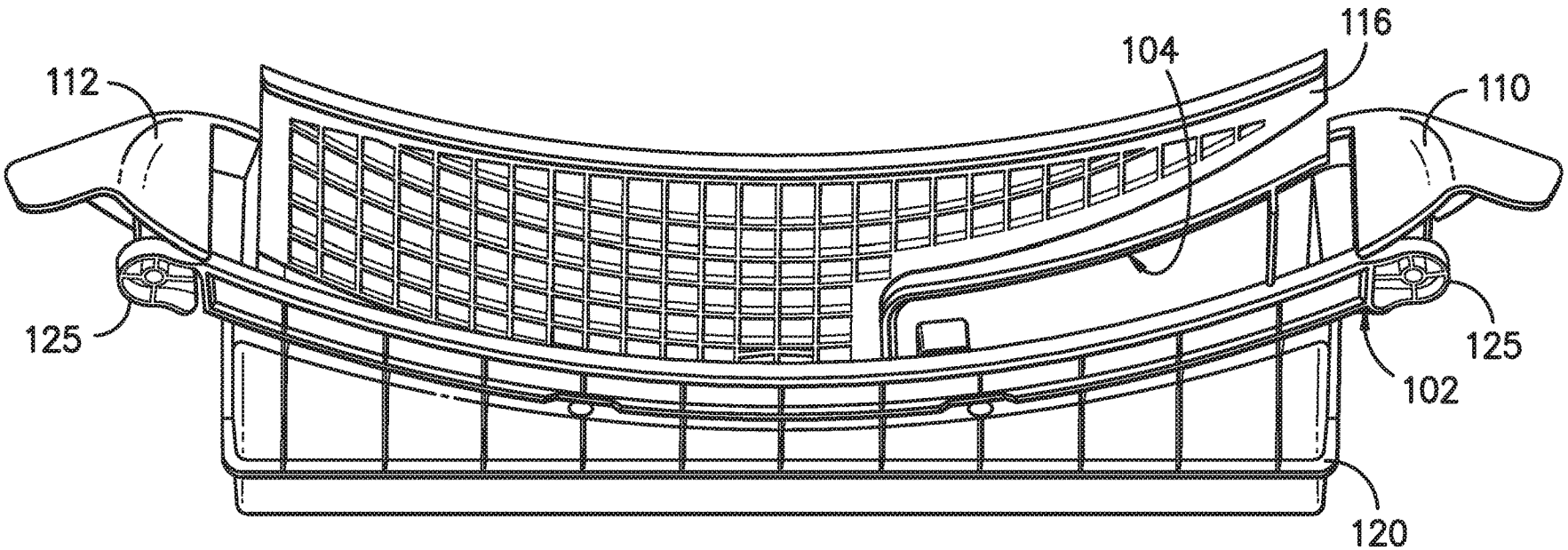
FIG. 7 provides a front perspective assembly view of an embodiment of a filter system without a filter in accordance with the present disclosure.

FIGS. 6 through 7, respectively, provide an exploded and an assembled view of filter system 100. FIG. 6 provides a view from the rear of filter system 100 (that is, as if one were within dryer appliance 10) with filter 118 removed. FIG. 7 provides a view from the front of filter system 100 (that is, as if one were outside dryer appliance 10 looking through, for example, front panel 14) with filter 118 removed.

Front housing 102 comprises a front wall 120, a first side wall 122, and a second side wall 124. Front wall 120 further includes one or more connection elements 125. In the embodiment of FIG. 6, bolts or screws may be inserted through connection elements 125 to secure front housing 102 to interior 62 of cabinet 12 and directly above vent duct 66. One skilled in the art will recognize that the present disclosure is not limited to any particular manner of connection between front housing 102 and cabinet 12, but could use any known connection mechanism (e.g., rivets, adhesives, etc.) or, alternatively, front housing 102 may be integral (e.g., formed as a unitary, monolithic element) with cabinet 102. Regardless of the type of connection employed, first side wall 122 and second side wall 124 may be substantially perpendicular to front wall 120 to provide a mounting surface for other elements of filter system 100 and to create a portion of the volume needed to house filter 118.

As further shown in the embodiments of FIGS. 6 through 7, rear housing 104 comprises a first end 106, a second end 108, a first guard 110, a second guard 112, an opening 114 between first guard 110 and second guard 112, and a base support 126. Rear housing 104 may be connected to front housing 102. For instance, first end 106 of rear housing 104 may connect to first side wall 122 of front housing 102, and second end 108 of rear housing 104 may connect to second side wall 124 of front housing 102. This connection may be made through any means known to those skilled in the art.

First guard 110 is on first end 106 of rear housing 104, as illustrated in the embodiment of FIG. 6. Second guard 112 is on second end 108 of rear housing 104, as also shown in FIG. 6. First guard 110 and second guard 112 may be spaced apart from each other. In some such embodiments, first guard 110 and second guard 112 extend along only a portion of base support 126 of rear housing 104 such that they do not directly connect or contact each other in the middle or otherwise (e.g., between first end 106 or second end 108). Thus, first guard 110 and second guard 112 may define an opening 114 between them.

As noted above, rear housing 104 further comprises a base support 126, which may connect first end 106 to second end 108. In some embodiments, base support 126 may be curved, extending away from front housing 102 (e.g., in order to increase the volume of space between front housing 102 and rear housing 104). When assembled, cleaning tools, such as vacuum cleaner attachments, may be permitted to access the space between front housing 102 and rear housing 104. In other embodiments (not pictured), the length of base support 126 may be straight, and first side wall 122 of front housing 102, second side wall 124 of front housing 102, first end 106 of rear housing 104, or second end 108 of rear housing 104 may be increased in order to generate a desired volume between front housing 102 and rear housing 104.

Figure 9:
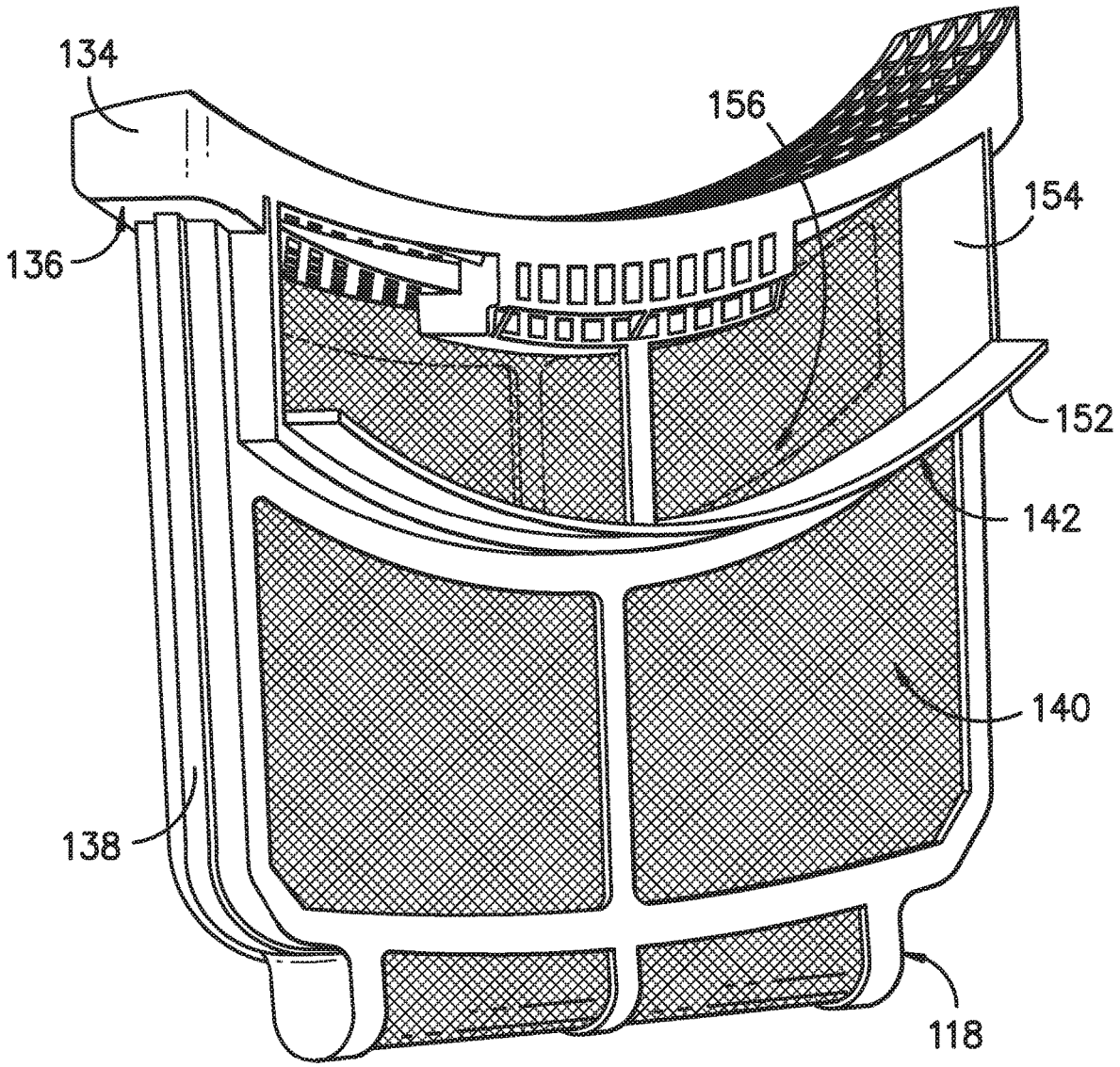
FIG. 9 provides a rear perspective view of an embodiment of a filter in accordance with the present disclosure.
Figure 10:
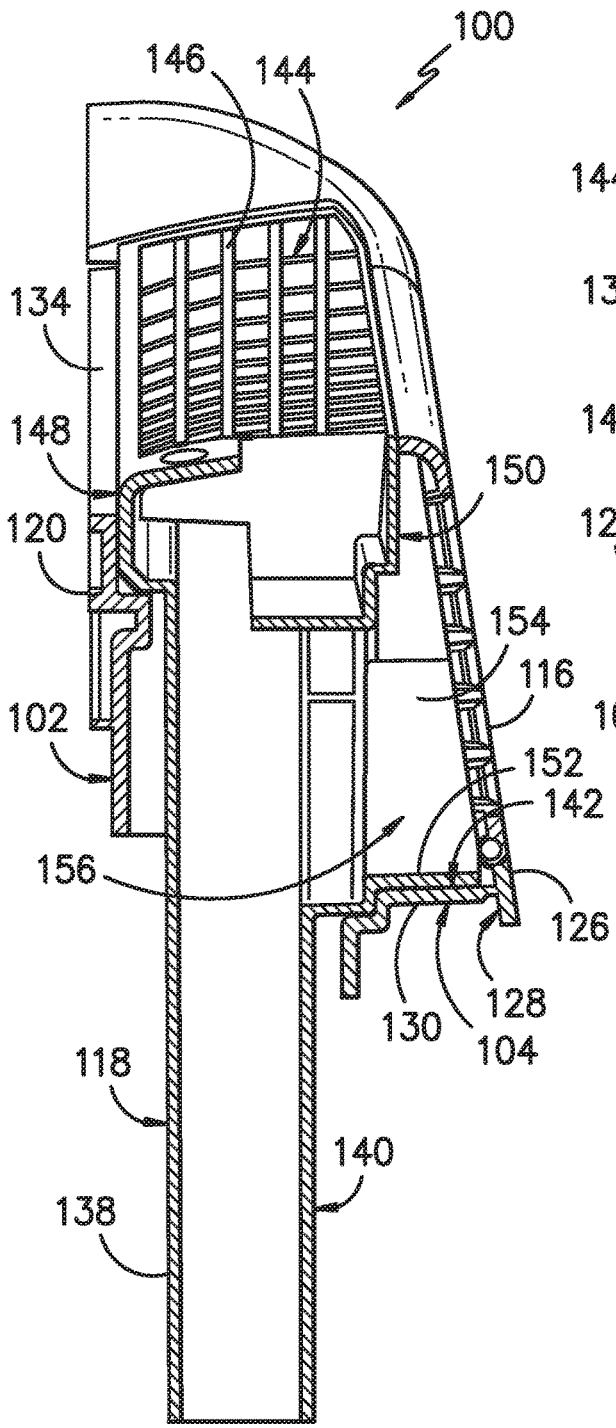
FIG. 10 provides a cross-sectional side perspective view of an embodiment of a filter system with a perforated grille in the closed position in accordance with the present disclosure.

As shown in FIGS. 9 through 10, base support 126 may comprise an inside face 128 in certain embodiments. In such embodiments, a support lip 130 may extend from at least a portion of inside face 128 of base support 126 toward front housing 102 for supporting filter 118.

Referring again to the embodiments of FIGS. 6 through 7, perforated grille 116 of filter system 100 may be pivotably attached to rear housing 104. More particularly, as shown in FIGS. 6 and 7, perforated grille 116 may attach to base support 126. In other embodiments, perforated grille 116 may attach to other elements of rear housing 104, such as first guard 110 or second guard 112. In the embodiment of FIG. 6, perforated grille 116 may employ rods 133 which snap onto a shaft 135 molded onto base support 126. However, any suitable hinged connection may be used to attach perforated grille 116 to rear housing 104.

Figure 11:
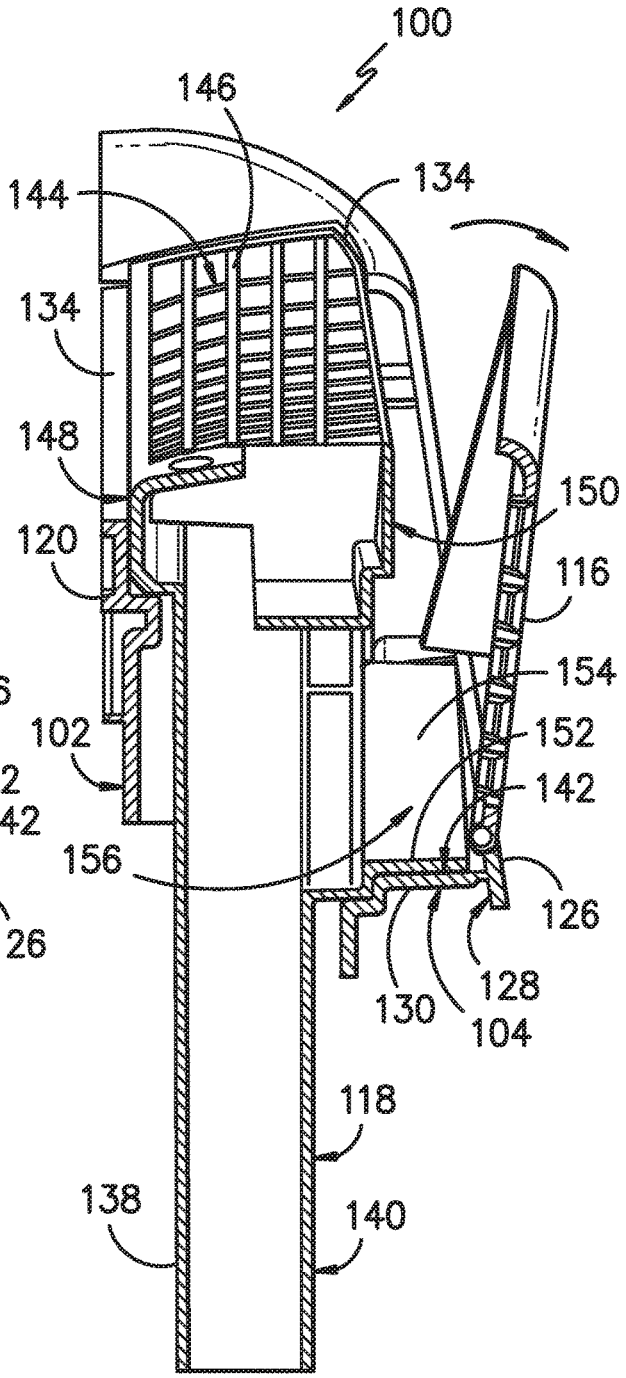
FIG. 11 provides a cross-sectional side perspective view of an embodiment of a filter system with a perforated grille in the open position in accordance with the present disclosure.

Perforated grille 116 may pivot between a closed position (e.g., as shown in the embodiment of FIG. 10) and an open position (e.g., as shown in the embodiment of FIG. 11). By pivoting perforated grille 116 to the open position, a user may increase the space available to introduce cleaning tools, such as vacuum cleaner attachment, into filter system 100. Conversely, when perforated grille 116 is in the closed position, at least a portion of perforated grille 116 may cover opening 114 (e.g., as shown in FIGS. 4 and 7) forcing at least a portion of air flowing from chamber 25 to vent duct 66 through perforated grille 116. Regardless of the type of hinged connection used, in some embodiments, perforated grille 116 may further include a spring 132 (e.g., torsion spring, compression spring, or tension spring) biasing perforated grille 116 toward the closed position. Optionally, the spring may be mounted on the hinged connection between perforated grille 116 and rear housing 104 (e.g., as a torsion spring).

As further shown in FIGS. 10 through 13, filter 118 may be removably mounted between front housing 102 and rear housing 104, enabling the user to remove filter 118 and conveniently clean away the lint and other particulates from the surface of filter 118 and to replace filter 118 for subsequent use.

Figure 8:
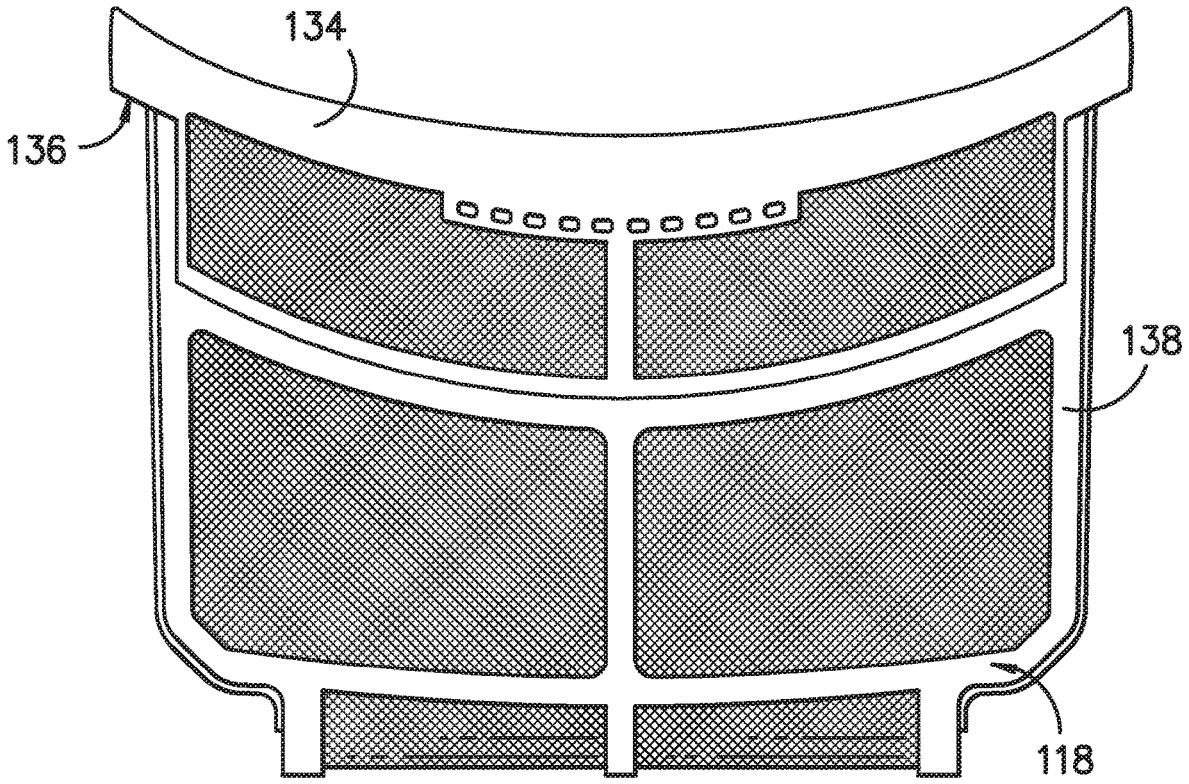
FIG. 8 provides a front view of an embodiment of a filter in accordance with the present disclosure.

FIGS. 8 and 9, provide front and rear perspective views of embodiments of filter 118, respectively. As shown in these embodiments, filter 118 may comprise a filter head 134, an elongated filter screen body 138, and a filter support 142. Filter head 134 has a bottom side 136. Filter screen body 138 is connected to bottom side 136 of filter head 134. Filter screen body 138 further has a rear side 140. The surface of filter screen body 138 may be primarily comprised of a mesh screen. Thus, as heated air passes from chamber 25, through filter system 100, and to vent duct 66, lint and other particulates transported by the air current may become trapped on or within the mesh screen of filter screen body 138, inhibiting the buildup of particulates downstream of filter system 100.

Filter support 142 is connected to rear side 140 of filter screen body 138. When filter 118 is mounted between front housing 102 and rear housing 104, filter support 142 may rest on support lip 130, maintaining the position of filter 118 and preventing particulates from entering vent duct 66 without interference from filter 118. In certain embodiments, filter support 142 further comprises a support base 152 and side walls 154, as shown in FIG. 9. Together, support base 152, side walls 154, and filter screen body 138 may define a lint collection cavity 156. Although lint and other particulates may collect in locations other than lint collection cavity 156, it will be recognized that, in the embodiment of FIG. 9, heavy accumulation of particulates would be expected at the location where lint collection cavity 156 is arranged within filter system 100 because such particulates might come to rest on support lip 130 of rear housing 104. During use, lint collection cavity 156 may advantageously capture these particulates and, upon removal of filter 118, prevent such particulates from falling into vent duct 66, which may lead to blockages that inhibit normal operation of dryer appliance 10. Additionally or alternatively, particulates may be easily and conveniently removed by simply removing filter 118, rather than attempting to access such particulates when still trapped within filter system 100 or otherwise enclosed within cabinet 12 (FIG. 1) or vent duct 66 (FIG. 2).

Figure 12:
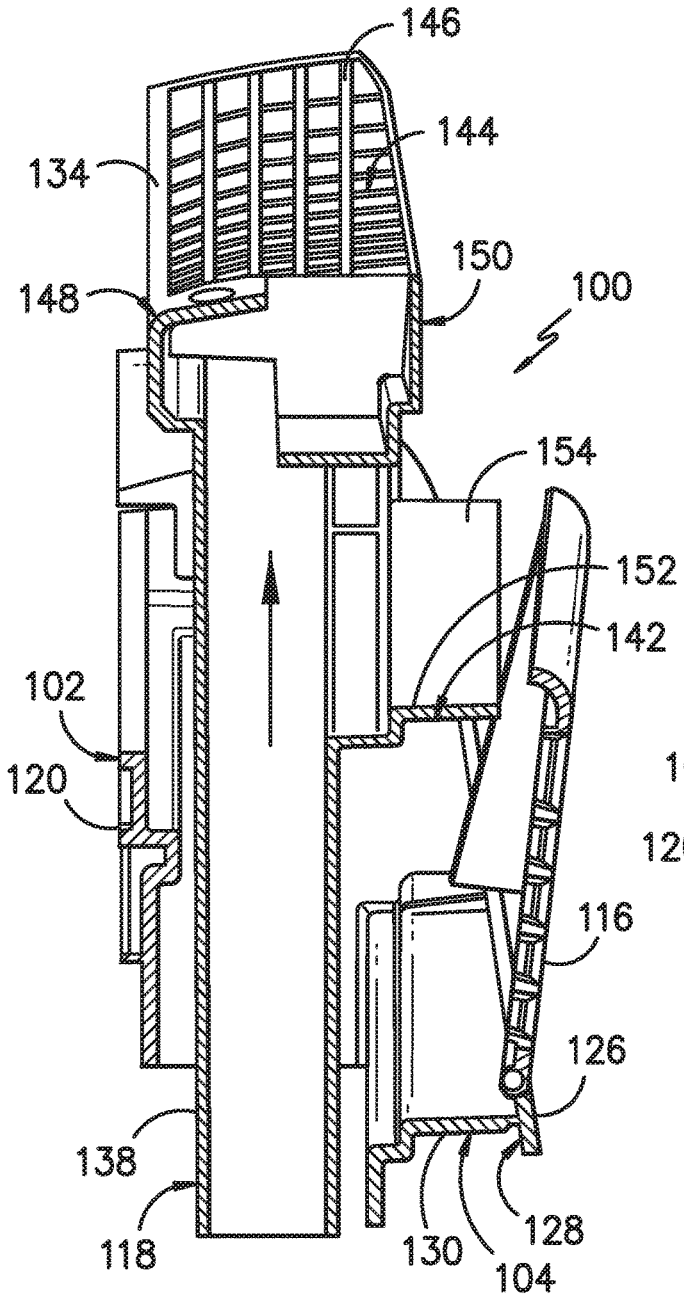
FIG. 12 provides a cross-sectional side perspective view of an embodiment of a filter system with a perforated grille in the closed position and a filter partially removed in accordance with the present disclosure.
Figure 13:
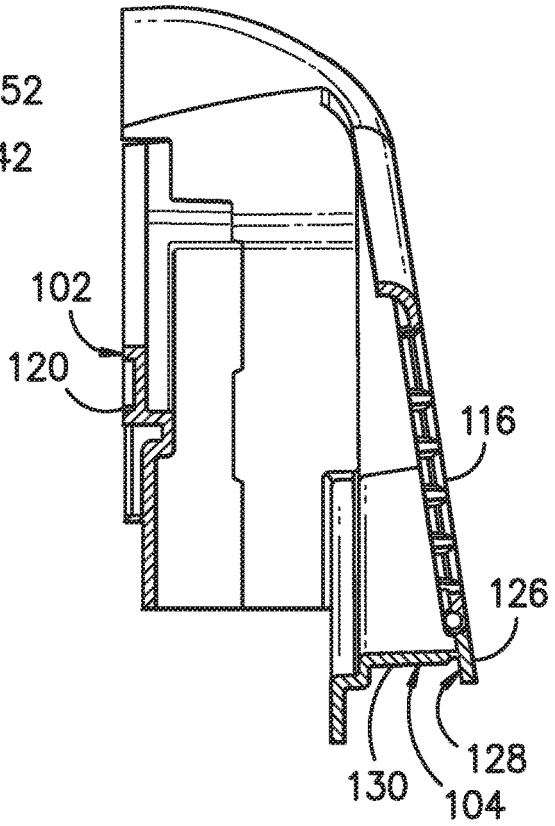
FIG. 13 provides a cross-sectional side perspective view of an embodiment of a filter system with a perforated grille in the closed position and without a filter in accordance with the present disclosure.

As shown in the embodiments of FIGS. 10 through 12, filter head 134 may define a top side 144, wherein filter head 134 comprises a filter grille 146 on top side 144. At least a portion of the air flowing from chamber 25 to vent duct 66 may also pass through filter grille 146. Filter grille 146 may therefore advantageously intercept lint and other particulates carried by the air current, preventing such particulates from reaching vent duct 66 and potentially accumulating over time.

Generally, filter system 100 enables removal of filter 118 when perforated grille 116 is in the open position and contains filter 118 when perforated grille 116 is in the closed position. Filter 118 has a front surface 148 and a rear surface 150, as shown in FIGS. 10 through 12. A maximum distance between front housing 102 and perforated grille 116 may be less than a maximum distance between front surface 148 of filter 118 and rear surface 150 of filter 118 when perforated grille 116 is in the closed position. A minimum distance between front housing 102 and perforated grille 116 may be greater than a maximum distance between front surface 148 of filter 118 and rear surface 150 of filter 118 when perforated grille 116 is in the open position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum positioned within the cabinet for receipt of articles for drying;

a filter system in fluid communication with the drum, the filter system comprising a front housing connected to the cabinet;

a rear housing connected to the front housing, the rear housing further comprising a first end;

a second end;

a first guard on the first end;

a second guard on the second end;

a perforated grille pivotably attached to the rear housing, the perforated grille pivoting between an open position and a closed position, wherein the perforated grille in the closed position is between the first guard and the second guard and defines a space between the perforated grille and the front housing; and a filter removably mounted between the front housing and the rear housing, the filter comprising a filter head having a bottom side, wherein the filter head occupies the space between the perforated grille and the front housing; and an elongated filter screen body connected to the bottom side of the filter head, the filter screen body having a rear side, and wherein the elongated body extends below the front housing and the rear housing.

2. The dryer appliance of claim 1, wherein the front housing comprises a front wall, a first side wall, and a second side wall, the first side wall and second side wall being perpendicular to the front wall.

3. The dryer appliance of claim 2, wherein the first end of the rear housing connects to the first side wall of the front housing and the second end of the rear housing connects to the second side wall of the front housing.

4. The dryer appliance of claim 3, wherein the rear housing further comprises a base support connecting the first end and the second end.

5. The dryer appliance of claim 4, wherein the base support comprises an inside face, a support lip extending from at least a portion of the inside face of the base support toward the front housing; and the filter further comprises a filter support connected to the rear side of the filter screen body, the filter support resting on the support lip.

6. The dryer appliance of claim 1, wherein the perforated grille further includes a spring biasing the perforated grille toward the closed position.

7. The dryer appliance of claim 5, wherein the filter support comprises a support base and side walls, the filter screen body, base support, and side walls defining a lint collection cavity.

8. The dryer appliance of claim 1, wherein the filter head defines a top side, and wherein the filter head comprises a filter grille on the top side.

9. The dryer appliance of claim 1, wherein the filter has a front surface and a rear surface;

a minimum distance between the front housing and the perforated grille is less than a maximum distance between the front surface of the filter and the rear surface of the filter when the perforated grille is in the closed position, and wherein a minimum distance between the front housing and the perforated grille is greater than a maximum distance between the front surface of the filter and the rear surface of the filter when the perforated grille is in the open position.

10. A filter system comprising:

a front housing;

a rear housing connected to the front housing, the rear housing further comprising a first end;

a second end;

a first guard on the first end;

a second guard on the second end;

a perforated grille pivotably attached to the rear housing, the perforated grille pivoting between an open position and a closed position wherein the perforated grille in the closed position is between the first guard and the second guard and defines a space between the perforated grille and the front housing; and a filter removably mounted between the front housing and the rear housing, the filter comprising a filter head having a bottom side, wherein the filter head occupies the space between the perforated grille and the front housing; and an elongated filter screen body connected to the bottom side of the filter head, the filter screen body having a rear side, and wherein the elongated body extends below the front housing and the rear housing.

11. The filter system of claim 10, wherein the front housing comprises a front wall, a first side wall and a second side wall, the first side wall and second side wall being perpendicular to the front wall.

12. The filter system of claim 11, wherein the first end of the rear housing connects to the first side wall of the front housing and the second end of the rear housing connects to the second side wall of the front housing.

13. The filter system of claim 12, wherein the rear housing further comprises a base support connecting the first end and the second end.

14. The filter system of claim 13 wherein the base support comprises an inside face, a support lip extending from at least a portion of the inside face of the base support toward the front housing; and the filter further comprises a filter support connected to the rear side of the filter screen body, the filter support resting on the support lip.

15. The filter system of claim 10, wherein the perforated grille further includes a spring biasing the perforated grille toward the closed position.

16. The filter system of claim 14, wherein the filter support comprises a support base and side walls, the filter screen body, base support, and side walls defining a lint collection cavity.

17. The filter system of claim 10, wherein the filter head defines a top side, and wherein the filter head comprises a filter grille on the top side.

18. The filter system of claim 10, wherein the filter has a front surface and a rear surface;

a minimum distance between the front housing and the perforated grille is less than the maximum distance between the front surface of the filter and the rear surface of the filter when the perforated grille is in the closed position; and wherein a minimum distance between the front housing and the perforated grille is greater than a maximum distance between the front surface of the filter and the rear surface of the filter when the perforated grille is in the open position.

* * * * *